US005465775A

United States Patent [19]

Biba et al.

[11] Patent Number: 5,465,775

[45] Date of Patent: Nov. 14, 1995

[54] VENETIAN BLIND WITH WAND OPERATOR

[75] Inventors: Scott I. Biba, Mazomanie; John R. Genova, Madison, both of Wis.

[73] Assignee: Springs Window Fashions Division, Inc., Middleton, Wis.

[21] Appl. No.: 304,512

[22] Filed: Sep. 12, 1994

Related U.S. Application Data

[63] Continuation-in-part of Ser. No. 266,125, Jun. 27, 1994.

[51] Int. Cl.[6] ..... E06B 9/30

[52] U.S. Cl. ..... 160/168.1; 160/178.1; 74/502

[58] Field of Search ..... 160/168.1 R, 168.1 V, 160/177 V, 177 R, 176.1 R, 176.1 V, 178.1 V, 178.1 R, 178.2 R, 319, 320, 321; 16/216, 217, 219, 114 R, 114 B; 254/385, 386; 74/502

[56] References Cited

U.S. PATENT DOCUMENTS 2,116,357 5/1938 Laborda et al. .
2,410,549 11/1946 Olson .
3,633,646 1/1972 Zilver .
5,028,843 8/1991 Sommerfeld ..... 160/168.1 V X
5,092,383 3/1992 Niemeijer et al. ..... 160/168.1 R X

*Primary Examiner*—Blair M. Johnson
*Attorney, Agent, or Firm*—Vernon J. Pillote

[57] ABSTRACT

A window blind of the type having a headrail, bottom rail and an expandable and contractable shade between the headrail and bottom rail. An elongated wand has an upper end mounted on the headrail and a flexible operating cord is formed into an endless cord operating loop and guided by loop guides in a closed loop path extending through the headrail and the wand passage. Lift cords are attached to the bottom rail and extend from the bottom rail into the headrail and the lift cords are connected to the endless operating loop. A cord lift handle member is mounted for movement along an outer side of the wand and has cord grip mechanism for gripping a portion of the endless cord operating loop to move the operating loop in a direction to raise the bottom rail when the handle member is moved in one direction along the wand. A cord lock is provided for releasably retaining the bottom rail in selected raised positions.

22 Claims, 4 Drawing Sheets

FIG. 1
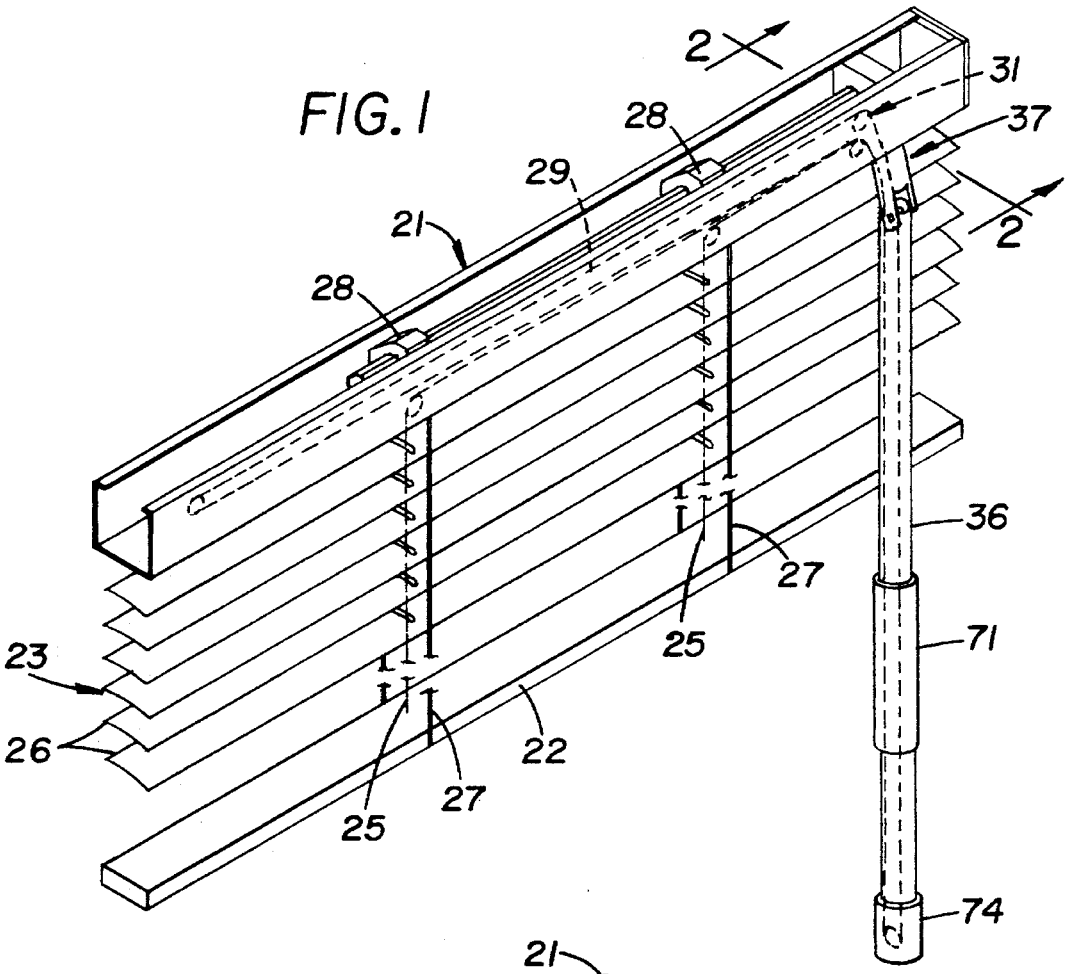
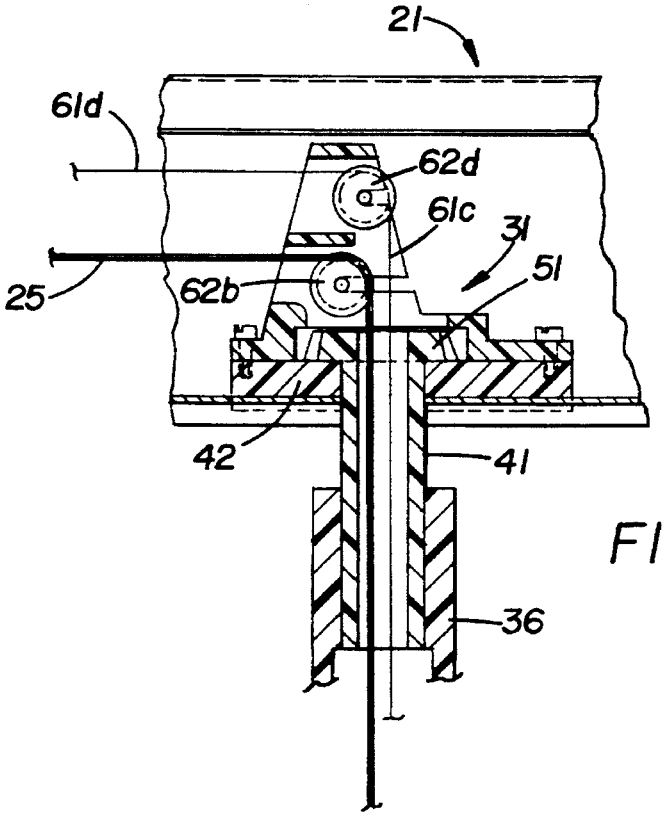
FIG. 3

VENETIAN BLIND WITH WAND OPERATOR

CROSS-REFERENCE TO RELATED APPLICATIONS

This application is a continuation-in-part of the application of Scott I. Biba and John R. Genova, Ser. No. 08/266,125, filed Jun. 27, 1994, entitled "Window Blind With Wand Operator".

BACKGROUND OF THE INVENTION

U.S. Pat. Nos. 2,116,357; 2,410,549 and 3,663,646 disclose venetian blinds having a wand operator for tilting the blind slats and in which the lift cords for raising the blinds extend through the wand. In U.S. Pat. No. 2,116,357, the wand is connected to a lever attached to the headrail of a venetian blind to tilt the headrail in response to lengthwise movement of the wand, and the lift cords extend downwardly through the wand and out the lower end to enable the lower ends of the lift cords to be manipulated by hand to raise and lower the blind. U.S. Pat. 2,410,549 uses a cord and pulley arrangement for tilting the slats in response to turning of the wand and the operating ends of the lift cords are attached to the lower end of the wand so that the lower portion of the wand must be attached and moved to raise and lower the blind. U.S. Pat. No. 3,663,646 discloses a wand connected to a tilt mechanism through a worm and worm gear drive so that the slats can be tilted in response to rotation of the wand. In this patent, the lift cords extend downwardly through the wand and out the lower end to enable the lower ends of the lift cords to manipulated by hand for raising and lowering of the blind, and a cord lock is provided at the lower end of the wand to lock the cords to the lower end of the wand. In each of these patents, the lift cords must extend out from the lower end of the wand a distance at least equal to the height of the blind when the blind is raised, to enable hand control of the cords during movement of the blind from a fully lowered to a fully raised condition. The dangling ends of the lift cords are not only aesthetically undesirable but also presents a potential safety hazard to children that can reach and play with such cords.

SUMMARY OF THE INVENTION

It is the general object of the invention to overcome the problems of the prior art window blinds having lift cords for raising and lowering the blind, by providing an improved lift cord operating mechanism in which the operating portions of the lift cords remain enclosed within the headrail and a wand that extends downwardly from the headrail, the operating mechanism including manually operable cord operating means movable along the wand to raise the blind and cord lock means for locking the blind in an adjusted positions.

Another object of this invention is to provide a venetian blind having an improved cord operating mechanism in accordance with the foregoing object for raising and lowering the blind, and in which the wand is also rotatable about its lengthwise axis to change the tilt of the slats for light control.

Accordingly, the present invention provides a window blind comprising a headrail, bottom rail, an expandable and contractable shade between the headrail and bottom rail, and an elongated wand having a lengthwise extending wand passage opening along one side of the wand and wand connecting means mounting an upper end of the wand on the headrail. Flexible operating cords are formed into an endless cord operating loop and loop guides in the headrail and in the wand guides the endless cord operating loop in a closed loop path extending from the headrail into the wand passage. Lift cord means are attached to the bottom rail and extend from the bottom rail into the headrail and the lift cord means are connected to the endless operating loop. A handle member is mounted for movement along an outer side of the wand and cord grip means are provided on the handle member for gripping a portion of the operating loop in the wand passage to move the operating loop in a direction to raise the bottom rail when the handle member is moved in one direction along the wand, and a cord lock is provided for releasably retaining the bottom rail in selected raised positions. The cord lock is preferably mounted on the wand.

The invention is especially adapted for use in venetian blinds in which the shade is formed of slats supported on flexible ladders with slat tilt operating means connected to the ladders for tilting the slats to effect light control. The slat tilt operating means includes mechanism responsive to turning of the wand for tilting the slats.

BRIEF DESCRIPTION OF THE DRAWINGS

FIG. 1 is a perspective view of the blind embodying the present invention;

FIG. 3 is a fragmentary longitudinal sectional view taken on the plane 3—3 of FIG. 2;

DETAILED DESCRIPTION

Figure 2:
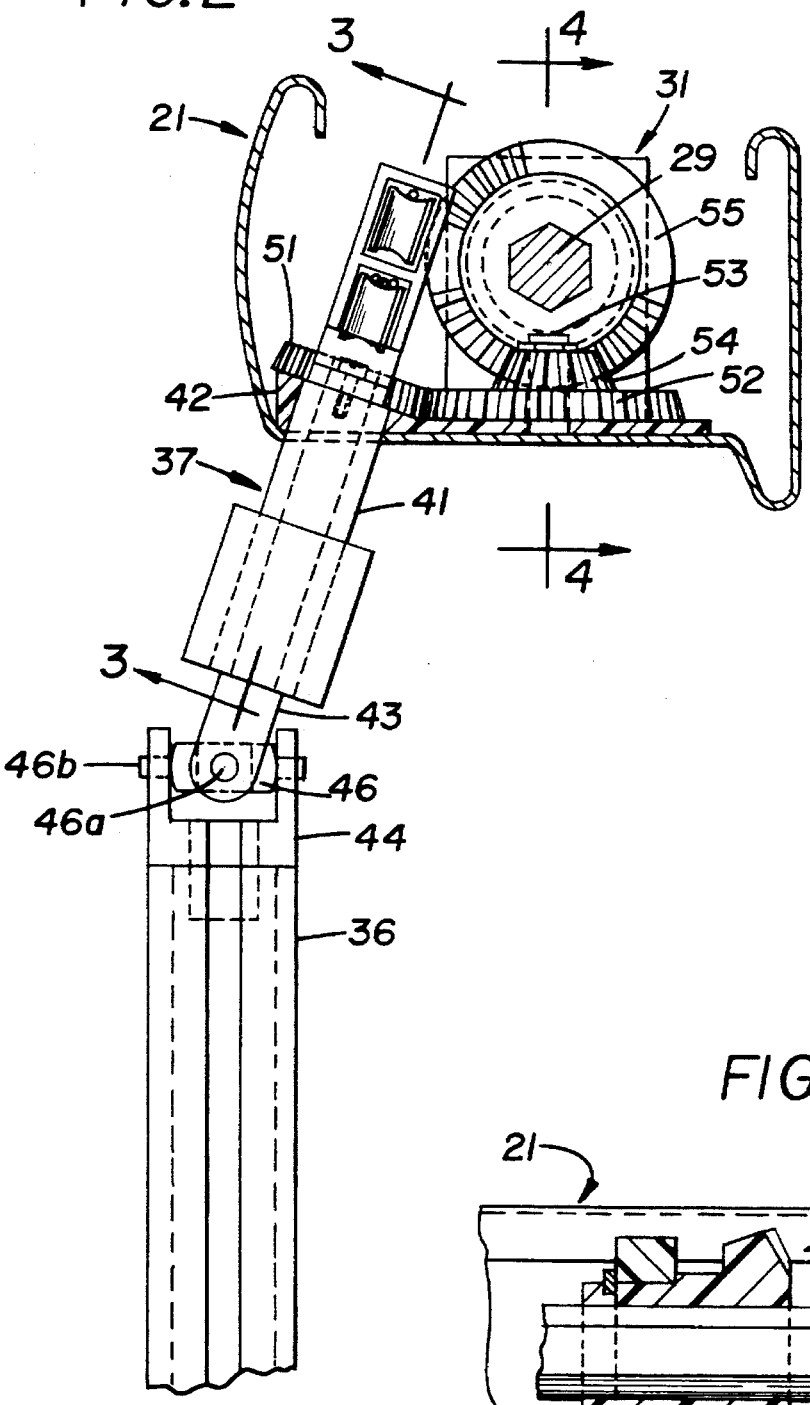
FIG. 2 is a transverse sectional view taken on the plane 2—2 of FIG. 1 illustrating parts on a larger scale than FIG. 1.

The invention relates to a window blind of the type having a headrail generally indicated by the numeral 21, a bottom rail 22, expandable and collapsible shade means 23 (FIG. 1) extending between the headrail and the bottom rail, and lift cords 25 that are connected at their lower ends to the bottom rail and which extend upwardly through or alongside the slats into the headrail. In the preferred embodiment illustrated, the window blind is of the venetian blind type having a plurality of slats 26 supported on flexible ladders 27. As is conventional, the ladders 27 each includes spaced cords or tapes with slat supports extending between the tapes at spaced locations therealong. A slat tilt device 28 is provided at the upper end of each of the ladders for relatively moving the spaced cords or tapes to tilt the slats for light control, and the tilt devices 28 are interconnected as by a rod 29 for simultaneous movement by a slat tilt operating mechanism 31.

A window blind control means is provided for controlling tilting of the slats and for raising and lowering the bottom rail. In general, the control means includes an elongated wand 36 having a lengthwise extending wand passage that opens in a slot 36*a* along one side of the wand, and wand connector means 37 for mounting the upper end of the wand on the headrail 21. The wand is preferably of tubular configuration and is herein shown having circular cross-section, it being understood that the wand could have other cross-sectional configuration, such as oval or polygonal. The wand connector means is arranged to swivelly support the wand on the headrail and to also provide a cord passage that extends between the headrail on the upper end of the internal wand passage. As best shown in FIG. 2, the wand connector means includes a tubular drive stem 41 mounted on a support base 42 in the headrail for rotation about a downwardly and forwardly inclined axis, and a universal joint of the type having a first yoke 43 non-rotatably attached to the stem 41, a second yoke 44 non-rotatably attached to the upper end of the wand 36 and an intermediate joint member 46. The intermediate joint member has first and second orthogonally disposed pivots 46*a*, 46*b* that are respectively connected to the first and second yokes 43 and 44. The yokes 43 and 44 and the intermediate joint member each have an axial passage therethrough so that the lift cords can pass through the stem 41 and through the universal joint into the wand.

Figure 4:
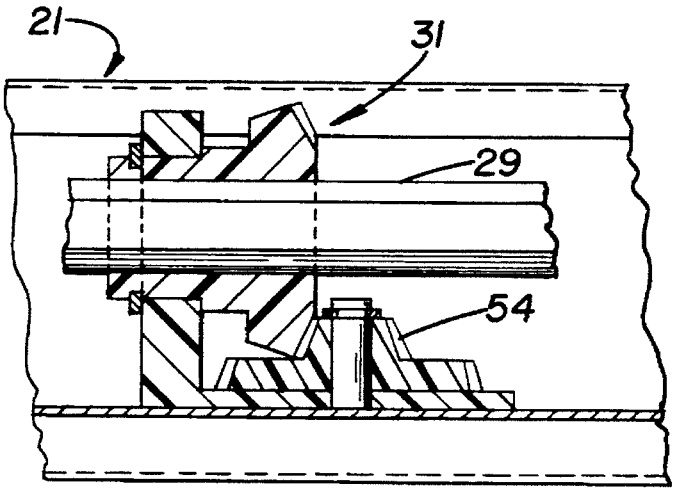
FIG. 4 is a fragmentary longitudinal sectional view taken on the plane 4—4 of FIG. 2.

The wand is operatively connected to the slat tilt operating mechanism 31 to effect tilting of the slats in response to the rotation of the wand about its lengthwise axis. As described more fully hereinafter, the lift cords are guided from the headrail into the upper end of the wand connector means and the driving connection between the wand connector means and the slat tilt operating mechanism is advantageously arranged so that the lift cords can enter and exit from the upper end of the wand connector means at a location adjacent the bottom wall of the headrail. The drive connection between the wand connector and the slat tilt operating mechanism is best shown in FIGS. 2–4 and includes a beveled gear 51 formed on the upper end of the tubular drive stem, and which meshes with a beveled gear 52 rotatably supported on the base 42 at a location adjacent the bottom wall of the headrail. The beveled gear 52 is mounted on a pin 53 for rotation about an upright axis transverse to the rod 29 and has an integral beveled gear 54 that meshes with a bevel gear 55 on the rod 29. The size of the gears 51, 52, 53 and 54 is preferably selected so as to provide a turn ratio of about 4 to 1 between wand turns and turns of the shaft 29 to enable accurate adjustment of the tilt angle and to hold the slats in adjusted position.

Figure 5:
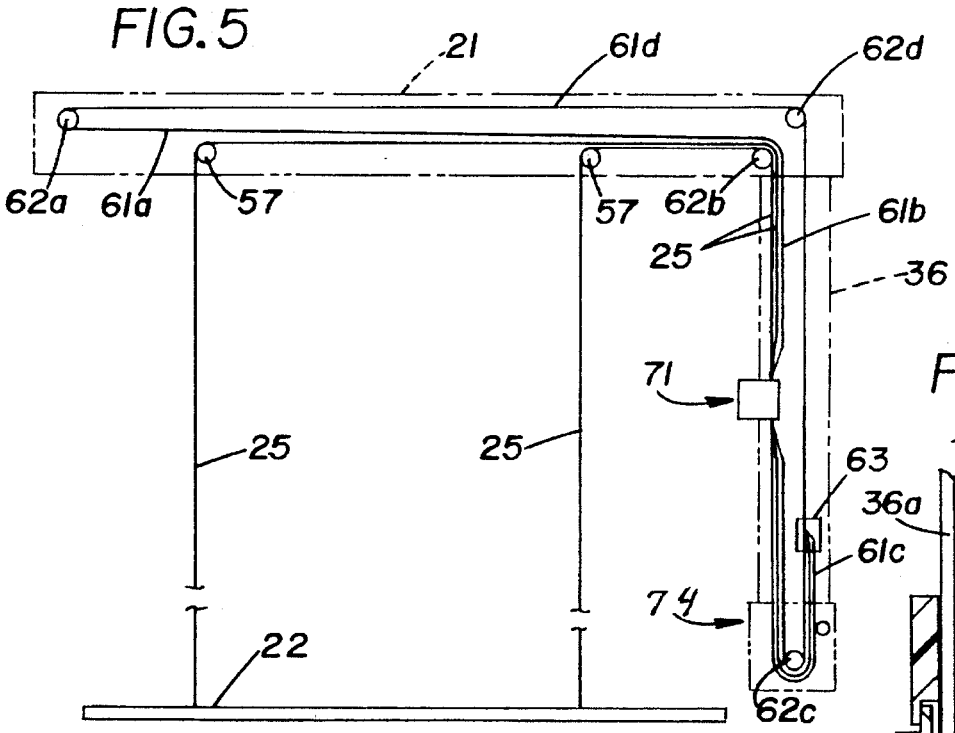
FIG. 5 is a diagrammatic view illustrating the lift cord and operating cord arrangement of the present invention.

As best shown in FIGS. 1 and 5, the lift cords 25 extend upwardly from the bottom rail through openings in the slats and into the headrail 21 through openings in the bottom thereof and then pass lengthwise to the headrail. Guides 57 (FIG. 5), which may be of the static type or pulley type, are provided for guiding the lift cords from the vertical runs in the blind to the horizontal runs in the headrail.

In accordance with the present invention, a flexible cord is connected and arranged to form an endless cord operating loop that extends through the headrail and through the wand. As diagrammatically shown in FIG. 5, the endless cord loop includes a run 61*a* that extends from a cord guide 62*a* at one end of the headrail and over a cord guide 62*b* adjacent the other end of the headrail, and a run 61*b* that extends downwardly in the wand and around a cord guide 62*c* at a lower end of the wand, and a run 61*c* that extends upwardly in the wand from the cord guide 62*c* and around a cord guide 62*d* in the head rail, and a run 61*d* that extends from the cord guide 62*d* back to the cord guide 62*a*. The ends of the lift cords 25 remote from the bottom rail 22, are attached to one run of the endless cord operating loop so that the lift cords operate to raise the bottom rail when the operating loop is moved in one direction and to lower the bottom rail when the operating loop is moved in an opposite direction. In the embodiment illustrated, the lift cords 25 are connected to the endless cord operating loop by a connector 63 at a location that lies intermediate the cord guide 62*c* at the lower end of the wand and the cord guide 62*d* in the headrail, when the bottom rail of the blind is in its lowermost position as shown in FIG. 5. With this arrangement, the lift cords 25 have a run that extends downwardly from the cord guide 62*b* alongside the run 61*b* of the cord operating loop and the lift cords extend around the guide 62*c* and then upwardly to the connector 63.

A cord lift handle member 71 is mounted for movement along the outer side of the wand and cord grip means 72 are provided on the handle member for gripping a portion of the operating loop in the wand passage to move the operating loop in one direction to raise the bottom rail when the handle member is moved in one direction along the wand. Cord lock means 74 are provided for releasably retaining the bottom rail in the raised position. In the preferred embodiment illustrated, the cord lock means are mounted on the wand and arranged to releasably hold the cord operating loop against movement in the direction opposite said one direction.

Figure 6:
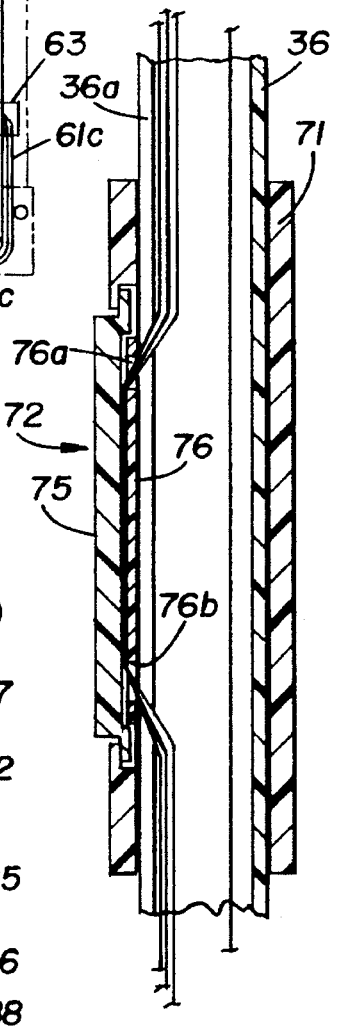
FIG. 6 is a fragmentary sectional view through the wand and lift cord operating handle for raising the blind.

The handle 71 and cord grip means 72 is best shown in FIG. 6. The cord grip means is preferably normally positioned in a cord release condition and is operable by a hand pressure for moving the grip means to a cord gripping position. The cord grip means includes a cord grip member 75 mounted on the handle 71 for movement with the handle along the wand and for limited movement relative to the handle in a direction crosswise of the wand. The member 75 is disposed in complementary opening in one side of the handle 71 and overlies a pad 76 that slidably engages the outer side of the wand. One run 61*b* of the operating cord loop and the lift cords 25 extend from the passage in the wand through an opening 76*a* in the pad 76 and between the pad and the member 75 and then back through an opening 76*b* in the pad to the wand passage. With this arrangement, the cord grip means is normally in a cord release condition and, when the cord grip member 75 is pressed toward the wand as by finger pressure, the cords are gripped between the member 75 and the pad 76 so the operating cord will move in one direction when the handle 75 is moved downwardly along the wand. The cord lock means 74 is arranged to releasably retain the cord loop against retrograde movement so that the cord grip means 72 can be released and the handle 71 raised on the wand for operation of one or more subsequent lift strokes.

Figure 7:
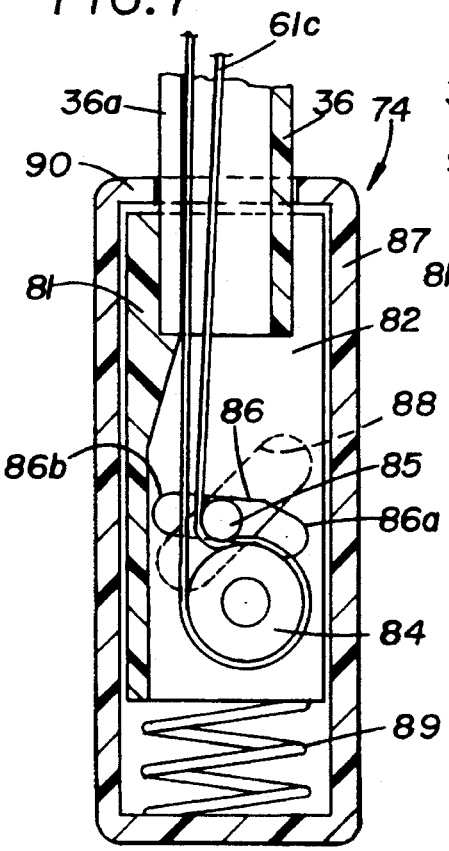
FIG. 7 is a sectional view through a first embodiment of a cord lock mounted on the wand.
Figure 8:
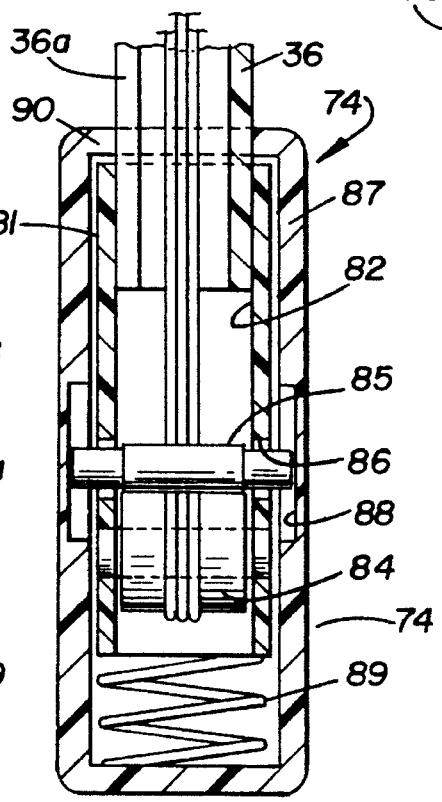
FIG. 8 is a sectional view through the cord lock of FIG. 7 taken on a plane transverse to the plane of FIG. 7.

A preferred embodiment of the cord lock means is shown in FIGS. 7 and 8. A cord lock body 81 is fixedly mounted on the lower end of the wand and provides a cavity 82 that communicates with the wand passage. The cord lock 75 includes a generally drum shaped member 84 preferably non-rotatably mounted in the cavity 82, and a cord lock roller 85 having ends mounted in opposed slots 86 in the body 81. In the embodiment illustrated, drum member 84 also functions as the cord guide 62*c* at lower end of the wand. As shown in FIG. 7 the slots 86 having one end portion 86*a* shaped so as to guide the roller 85 toward the periphery of the drum member 84 and a second portion 86*b* that extends outwardly of the periphery of the drum member.

The run 61*b* of the endless cord loop extends downwardly around the drum 84 and then under the cord lock roller 85 to the run 61*c*. When the cord lift operating handle 71 and cord grip 72 are operated to pull the run 61*b* of the cord operating loop downwardly, the tension on the run 61*c* of the operating loop is relieved and roller 85 shifts to the left to allow the cords to pass around the drum. When the cord grip on the handle is released, the run 61*c* of the cord loop is tensioned by the weight of the blind and shifts the roller 85 to the right as viewed in FIG. 7 to clamp the cord against the drum 84 and lock the cords against retrograde movement. A manually operable cord lock release is provided and includes a lock handle 87 that is slidable in a direction paralleling the length of the wand relative to the body 81. The lock handle 87 has inclined grooves 88 that receive outer ends of the roller 85. The grooves are inclined at an angle to the path of movement of the handle relative to the body 81 so as to cam the roller 85 to a cord release position when the lock handle is moved upwardly relative to the body from the position shown in FIG. 7. The lock handle is yieldably urged downwardly relative to the body 81 by a spring 89 and stops 90 are provided for limiting downward movement of the lock handle to the position shown in FIG. 7. Thus, the cord lock can be manually actuated to a cord release position by manually moving the lock handle 87 upwardly.

Figure 9:
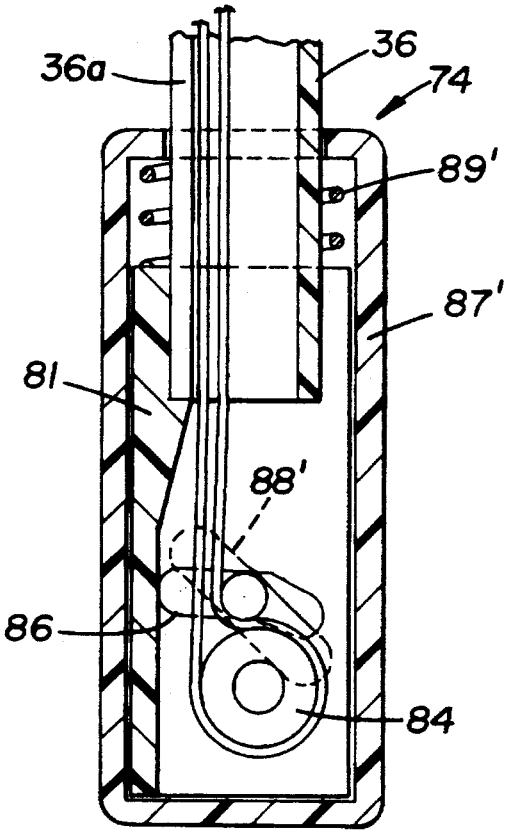
FIG. 9 is a sectional view through a second embodiment of a cord lock mounted on the wand.

A modified form of cord lock is illustrated in FIG. 9. This embodiment is the same as FIGS. 7 and 8 and like numerals are used to designate the same parts, with like numerals followed by the postscript ' used to designate modified parts. In this embodiment, the spring 89' is arranged to yieldably urge the lock handle 87' to a raised position relative to the lock body 81 and the cam slot 88' in the handle 87' is inclined at an angle so as to move the roller 85 to a cord release condition when the lock handle 87' is moved downwardly. With this arrangement, the cord lift operating handle 71 can be moved downwardly without actuating the cord grip means 72, until the operating handle 71 engages the lock handle 87' to release the cord lock and allow the blind to lower under the control of the manually operable cord grip means 72.

Figure 10:
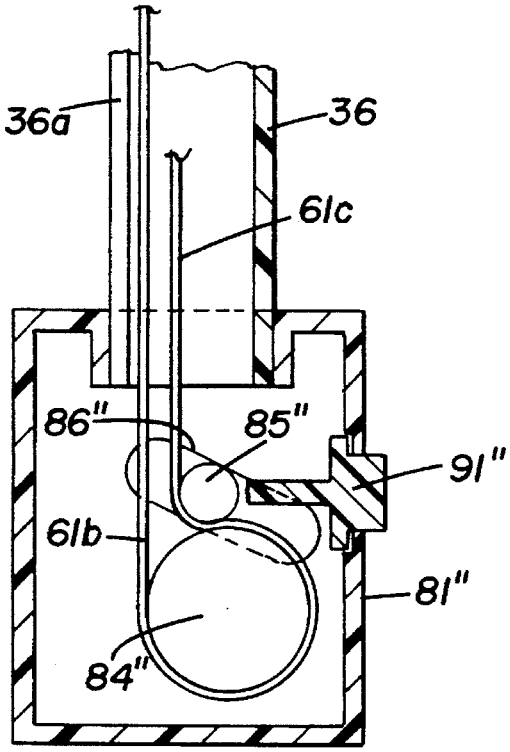
FIG. 10 is a sectional view through a third embodiment of a wand mounted cord lock.

A further modified form of cord lock is illustrated in FIG. 10 and in this embodiment, a drum shape member 84" is mounted in a cord lock body 81" and a cord lock roller 85" has ends guided in opposed slots 86" for movement between a locked condition as shown in FIG. 10 and a release condition. As in the preceding embodiments, the run 61*b* cord operating loop extends around the drum 85" and under the cord lock roller 85" to the run 61*c* and the grooves 86" in the cord lock body are shaped to guide the cord lock roller to a locked condition when the run 61*b* is tensioned. A means such as a push button 91" is mounted on the cord lock body for operation by a finger pressure to move the roller 85" to a release condition.

From the foregoing it is believed the construction and operation of the window blind with wand operator will be readily understood. The lift cords 25 are advantageously connected by the connector 63 to the endless cord operating loop 61*a*–61*d* at a location such that the connector is located in the run 61*c* when the bottom rail is in its fully lowered position, so that the connector does not pass through either the cord grip means on the operating handle 71 or the cord lock means 74 on the lower end of the wand. The cord grip means 72 on the operating handle 71 can be selectively operated by finger pressure on the member 75 to grip the cord loop and the lift cords 25 to raise the bottom rail 22 when the operating handle 71 is moved downwardly along the wand. The cord lock locks the lift cords against retrograde movement when the run 61*b* is tensioned upwardly by the weight of the blind, as occurs when the cord grip means 72 is released, to thereby hold the blind in a raised position. The cord lift operating handle and cord grip means 72 can be operated in a series of downward strokes to raise the blind in step fashion. Thus, the wand can be substantially shorter than the full height of the blind and of a length such as to position the cord lift handle member 71 and cord lock release mechanism at a convenient location. Since the ends of the lift cords are attached to the endless cord operating means, the lift cords are retained within the wand and headrail in all positions of the blind. Further, in venetian blind type window shades, the wand is connected to the shade operating mechanism for the venetian blind to effect tilting of the slats in response to rotation of the wand.

The embodiments of the invention in which an exclusive property or privilege is claimed are defined as follows:

1. A window blind comprising: a headrail, a bottom rail, expandable and contractable shade means between the headrail and bottom rail, an elongated wand having a lengthwise extending wand passage and wand connector means for mounting the upper end of the wand on the headrail, flexible cord means providing an endless cord operating loop, loop guide means including at least one loop guide in the headrail and a loop guide on the wand for guiding the endless cord operating loop in a closed loop path extending from the headrail and into the wand passage, lift cord means attached to the bottom rail and extending from the bottom rail into the headrail, means connecting the lift cord means to the endless operating loop, a handle member mounted for movement along an outer side of the wand and cord grip means on the handle member operable to grip a portion of the operating loop in the wand passage and move the operating loop in one direction to raise the bottom rail when the handle member is moved in one direction along the wand, and cord lock means for releasably retaining the bottom rail in raised positions.

2. A window blind according to claim 1 wherein the length of the closed loop path is greater than the length of the wand.

3. A window blind according to claim 1 wherein the wand is mounted adjacent one end of the headrail, at least one of the loop guide means in the headrail being spaced along the headrail from the wand.

4. A window blind according to claim 1 wherein said grip means is normally in a cord release condition, said grip means including means on the handle member operable by hand pressure for moving the grip means into a cord gripping condition.

5. A window blind according to claim 1 wherein said cord lock means is mounted on the wand and engages the cord operating loop in the wand.

6. A window blind according to claim 5 wherein said cord lock means is mounted on a lower end of the wand.

7. A window blind according to claim 1 wherein said cord lock means is arranged to releasably clamp the operating cord loop to the loop guide in the wand.

8. A window blind according to claim 7 including cord lock release means having a manually operable actuating member mounted on wand for movement in a direction crosswise of the wand.

9. A window blind according to claim 7 including cord lock release means having a manually operable actuating member mounted on the wand for movement in a direction lengthwise of the wand.

10. A window blind according to claim 1 wherein expansible and contractable shade means includes a plurality of slats supported by flexible ladder means extending between the headrail and bottom rail, said wand connector means mounting the upper end of the wand on the headrail for turning movement relative thereto, and slat tilt means connected to the ladder means and responsive to turning of the wand for tilting the slats.

11. A window blind according to claim 1 wherein the window blind is expansible to a window closing condition and said lift cords extend from the headrail downwardly into the wand and at least past said cord grip means when the window blind is in a window closing condition.

12. A window blind comprising, a headrail, a bottom rail, flexible ladder means between the bottom rail and headrail and supporting a plurality of slats, lift cord means having one end connected to the bottom rail and extending from the bottom rail into the headrail, control means for tilting the slats and for raising and lowering the bottom rail, said control means including an elongated wand having lengthwise extending wand passage means opening along one side of the wand and wand connector means for mounting the upper end of the wand on the headrail for turning relative thereto, slat tilt operating means connected to the ladder means and responsive to turning of the wand for tilting the slats, the wand connector means providing cord passage means between the headrail and an upper end of the wand passage means, flexible cord means connected to the lift cord means and providing an endless cord operating loop, loop guide means including a loop guide adjacent a lower end of the wand and at least one loop guide in the headrail for guiding the endless cord operating loop in a closed loop path extending from the headrail and into the wand passage, manually operable lift cord operating means including a handle member mounted for movement along an outer side of the wand and cord grip means on the handle member operable to grip a portion of the operating loop in the wand passage and move the operating loop in a direction to raise the bottom rail in response to movement of the handle member in one direction along the wand, and cord lock means for releasably engaging a portion of the operating loop to retain the bottom rail in raised positions.

13. A window blind according to claim 12 wherein the window blind is expansible to a window closing condition and said lift cords extend from the headrail downwardly into the wand and at least past said cord grip means when the window blind is in window closing condition.

14. A window blind according to claim 12 wherein the length of the closed loop path is greater than the length of the wand.

15. A window blind according to claim 12 wherein the wand is mounted adjacent one end of the headrail, at least one of the loop guide means in the headrail being spaced along the headrail from the wand.

16. A window blind according to claim 12 wherein said grip means is normally in a cord release condition, said grip means including means on the handle member operable by hand pressure for moving the grip means into a cord gripping condition.

17. A window blind according to claim 12 wherein said cord lock means is mounted on the wand and engages the cord operating loop in the wand.

18. A window blind according to claim 17 wherein said cord lock means is mounted on a lower end of the wand.

19. A window blind according to claim 12 wherein said cord lock means is arranged to releasably clamp the operating cord loop to the loop guide in the wand.

20. A window blind according to claim 19 including cord lock release means having a manually operable actuating member mounted on wand for movement in a direction crosswise of the wand.

21. A window blind according to claim 19 including cord lock release means having a manually operable actuating member mounted on the wand for movement in a direction lengthwise of the wand.

22. A window blind according to claim 1 including cord lock release means having an actuating member mounted on the wand for movement in a downward direction relative to the wand to release the cord lock means.

* * * * *